US011255619B2

(12) United States Patent
Kollar et al.

(10) Patent No.: US 11,255,619 B2
(45) Date of Patent: Feb. 22, 2022

(54) HEAT EXCHANGER

(71) Applicant: Hanon Systems, Daejeon (KR)

(72) Inventors: Gregus Jan Kollar, Skalica (SK); Josef Lapcik, Susice (SK); Joerg Martini, Pulheim (DE)

(73) Assignee: Hanon Systems, Daejeon (KR)

( * ) Notice: Subject to any disclaimer, the term of this patent is extended or adjusted under 35 U.S.C. 154(b) by 115 days.

(21) Appl. No.: 16/608,367

(22) PCT Filed: Jun. 7, 2018

(86) PCT No.: PCT/KR2018/006436
§ 371 (c)(1),
(2) Date: Oct. 25, 2020

(87) PCT Pub. No.: WO2018/236077
PCT Pub. Date: Dec. 27, 2018

(65) Prior Publication Data

US 2021/0108869 A1 Apr. 15, 2021

(30) Foreign Application Priority Data

Jun. 22, 2017 (DE) ..... 10 2017 113 835.8
May 15, 2018 (DE) ..... 10 2018 111 556.3

(51) Int. Cl.
*F28F 21/06* (2006.01)
*F28D 1/053* (2006.01)
(Continued)

(52) U.S. Cl.
CPC ..... *F28F 21/067* (2013.01); *F28D 1/05383* (2013.01); *F28F 9/0224* (2013.01);
(Continued)

(58) Field of Classification Search
CPC ..... F28F 21/062; F28F 9/0226; F28F 9/0251; F28F 9/165; F28F 2230/00;
(Continued)

(56) References Cited

U.S. PATENT DOCUMENTS 4,651,821 A * 3/1987 Moranne ..... F28D 1/05333 165/175
5,899,267 A * 5/1999 Kroetsch ..... F28F 9/0226 165/173
(Continued)

FOREIGN PATENT DOCUMENTS

DE 19543740 A1 * 5/1997 ..... F28F 21/067
DE 102015113905 A1 2/2016
(Continued)

*Primary Examiner* — Devon Russell
(74) *Attorney, Agent, or Firm* — Norton Rose Fulbright US LLP; James R. Crawford

(57) ABSTRACT

The present disclosure relates to a heat exchanger including a plurality of fluid guiding metal pipes (2) having pipe ends (3) arranged side by side at intervals, at least one pipe bottom (4) made of plastic and having receiving through-holes (5) in which the pipe ends (3) may be received, and a collection box (6) made of plastic and which may be connected to the pipe bottom (4) by a locking device formed between the pipe bottom and the collection box, wherein a seal (9) may be inserted between the pipe bottom (4) and the collection box (6), and the seal ensures press-fit of the pipe bottom (4) on the pipe ends (3) and seals the collection box (6) against the pipe bottom (4) and the pipe bottom (4) against the pipe ends (3).

3 Claims, 6 Drawing Sheets

(51) Int. Cl.

| | |
|---|---|
| ***F28F 9/02*** | (2006.01) |
| ***F28F 9/16*** | (2006.01) |
| ***F28F 9/18*** | (2006.01) |
| *F28D 21/00* | (2006.01) |

(52) U.S. Cl.
CPC ..... *F28F 9/0226* (2013.01); *F28F 9/0251* (2013.01); *F28F 9/165* (2013.01); *F28F 9/182* (2013.01); *F28D 2021/008* (2013.01); *F28F 21/062* (2013.01); *F28F 2230/00* (2013.01); *F28F 2275/14* (2013.01)

(58) Field of Classification Search
CPC ..... F28F 2275/14; F28F 9/18; F28F 9/187; F28F 21/067; F28D 1/05383; F28D 2021/008
See application file for complete search history.

(56) References Cited

U.S. PATENT DOCUMENTS 6,311,768 B1 11/2001 Jamison et al.
7,121,329 B2 * 10/2006 Shields ..... F28F 9/001 165/149
2003/0217838 A1 * 11/2003 Dey ..... F28F 9/0246 165/173
2010/0170668 A1 * 7/2010 Nies ..... F28F 9/0224 165/173
2014/0262187 A1 * 9/2014 Gruber ..... F28D 1/05366 165/181
2015/0153114 A1 * 6/2015 Riondet ..... F28F 9/0226 165/168
2016/0054069 A1 * 2/2016 Armsden ..... B21D 53/085 165/173
2017/0131043 A1 * 5/2017 Contet ..... F28F 9/0229
2017/0299288 A1 * 10/2017 Bry ..... F28F 19/00
2018/0187985 A1 * 7/2018 Boisselle ..... F28F 9/165

FOREIGN PATENT DOCUMENTS

JP S58153097 A 9/1983
JP 2002531271 A 9/2002
JP 2015127631 A 7/2015
WO 2016207177 A1 12/2016

* cited by examiner

HEAT EXCHANGER

This application is a national phase under 35 U.S.C. § 371 of International Application No. PCT/KR2018/006436 filed Jun. 7, 2018, which claims the benefit of priority from Korean Patent Application Nos. 10 2017 113 835.8 filed on Jun. 22, 2017, and 10 2018 111 556.3 filed on May 15, 2018, each of which is hereby incorporated by reference in its entirety.

TECHNICAL FIELD

The present disclosure relates to a heat exchanger characterized by improved durability and reduced weight for variation in temperature. Such a heat exchanger is particularly suitable for application to vehicles.

BACKGROUND ART

A heat exchanger, which is known in the related art and used as an aluminum-water-air cooler in vehicles, typically consists of a cooling network formed by a pipe, a multi-disk, sides, and a pipe bottom, which are made of aluminum. In this case, a water box, also referred to as a collection box or a header, is typically sealed against the cooling network through an EPDM-seal. As is known, the connection between the pipe bottom and the collection box may be brazed or inserted.

When the heat exchanger is brazed, the rigid connection caused by the brazing is proved as a disadvantage especially when the variation in temperature is rapid because the material stress caused by thermal expansion has a negative effect on the durability of the heat exchanger.

By allowing the inserted connection to slide between the pipe and the pipe bottom, it is possible to compensate for the resulting change in length of the material caused by the variation in temperature. However, the disadvantage of the insertion of the connection is that the bottom of the aluminum pipe is typically connected to the collection box through crimp-connection, and this connection requires the pipe bottom to protrude relatively high. This requires a space that is unavailable for heat transfer. The heat exchanger is required as a plug-type cooler for vehicles, which makes better use of an available installation space and has a lower weight compared to known solutions.

DISCLOSURE

Technical Problem

An object of the present disclosure is to provide a heat exchanger having improved installation space utilization and relatively less weight.

Technical Solution

The above object is accomplished by a heat exchanger having the features according to claim 1. Improved implementations and modified embodiments are set forth in the dependent claims, respectively.

The heat exchanger according to the present disclosure includes a plurality of fluid guiding metal pipes that may be arranged side by side in the longitudinal direction in one block. In this case, the pipe ends of the metal pipes as pipe protrusions are arranged at intervals from each other. The heat exchanger according to the present disclosure includes at least one pipe bottom formed with a plurality of receiving through-holes. The arrangement of the receiving through-holes of the pipe bottom coincides with the arrangement of the pipe ends, with the consequence that the pipe bottom may be seated on the pipe ends, in which case the pipe ends may be received in the receiving through-holes. In addition, there is provided a collection box made of plastic, and the collection box is connected to the pipe bottom by a locking device formed between the pipe bottom and the collection box, in which case a seal may be inserted between the pipe bottom and the collection box, which ensures the press-fit of the pipe bottom on the pipe ends and seals the collection box against the pipe bottom and the pipe bottom against the pipe ends.

Since the pipe bottom and the collection box are made of plastic, a weight reduction of about 50% can be achieved for components made of aluminum. Therefore, the advantage of the heat exchanger according to the present disclosure is substantially reduced weight. Furthermore, by the use of more advantageous plastic for aluminum, material costs can also be saved.

According to an embodiment of the heat exchanger of the present disclosure, since the seal is a compressible elastomeric seal having through-insertion openings with through-insertion extensions for the pipe ends, as a result, it can be proposed that the seal is inserted between the inner surfaces of the receiving through-holes and the outer circumferences of the pipe ends. Preferably, the shapes of the cross-sections of the through-insertion openings and the shapes of the cross-sections of the through-insertion extensions coincide with the shapes on the outer circumferences of the pipe ends. Preferably, the inner circumferences of the through-insertion openings and the inner circumferences of the through-insertion extensions are smaller than the outer circumferences of the pipe ends, thereby ensuring the press-fit.

The elastomeric seal may be implemented as a separate component and may be separately inserted between the pipe ends, the pipe bottom, and the collection box when seating the pipe bottom on the pipe ends. However, it is also possible to propose a method in which the seal is integrated or inserted into the pipe bottom or the collection box by injection molding, especially combined injection molding. By injecting the seal into the pipe bottom or the collection box by the combined injection molding, the seal becomes a constituent part of the associated component, respectively. This reduces the complexity of the arrangement and reduces costs due to ease of component assembly because the seal does not need to be inserted separately.

According to a modified embodiment of the heat exchanger of the present disclosure, it can be proposed that the seal is inserted between the pipe bottom and the collection box by welding in a material combination manner of the pipe bottom and the collection box. In this case, the seal is formed by melting plastic which is a material of the collection box and the pipe bottom. By means of the welding process, the plastic of the pipe bottom may also be deformed to ensure the press-fit of the pipe bottom on the pipe ends. Thus, the welding the plastic of the pipe bottom and the collection box allows for the connection in the material combination manner of components such as the pipe bottom and the collection box and the sealing against the pipe ends. Preferably, the pipe bottom and the collection box are welded to each other when seated on the pipe ends.

On the facing inner surfaces of the collection box and the pipe bottom, junction points or welding points arranged at intervals from each other may be provided in which the collection box and the pipe bottom may be welded to each other. Preferably, the welding points are distributed throughout the circumference of the arrangement consisting of the collection box and the pipe bottom, resulting in uniform connection. By means of point welding at the welding points, mechanical additional interconnection protruding over the locking connection of the locking device is made between the components such as the collection box and the pipe bottom.

The locking device may include clips arranged in the pipe bottom or the collection box and locking openings arranged to face the clips in the pipe bottom or the collection box. Thus, it is possible to propose a modified embodiment in which the clips are formed in the collection box, in which case the locking openings are formed to face each other on the pipe bottom. In this case, the clips and the facing locking openings, in which the clips are engaged to form the locking connection, are preferably equally distributed throughout the length of the arrangement formed from the pipe bottom and the collection box. Due to the locking connection, a lower insertion depth of the pipe bottom is required, which is beneficial in utilizing the available heat transfer area.

Advantageous Effects

The concept of the heat exchanger according to the present disclosure enables weight reduction and cost savings by using plastic for the pipe bottom and the collection box. The heat exchanger according to the present disclosure is particularly suitable for use in vehicles.

DESCRIPTION OF DRAWINGS

Further details, features and advantages of the present disclosure will be apparent from the following detailed description of embodiments with reference to the accompanying drawings, in which.

BEST MODE FOR DISCLOSURE

Figure 1:
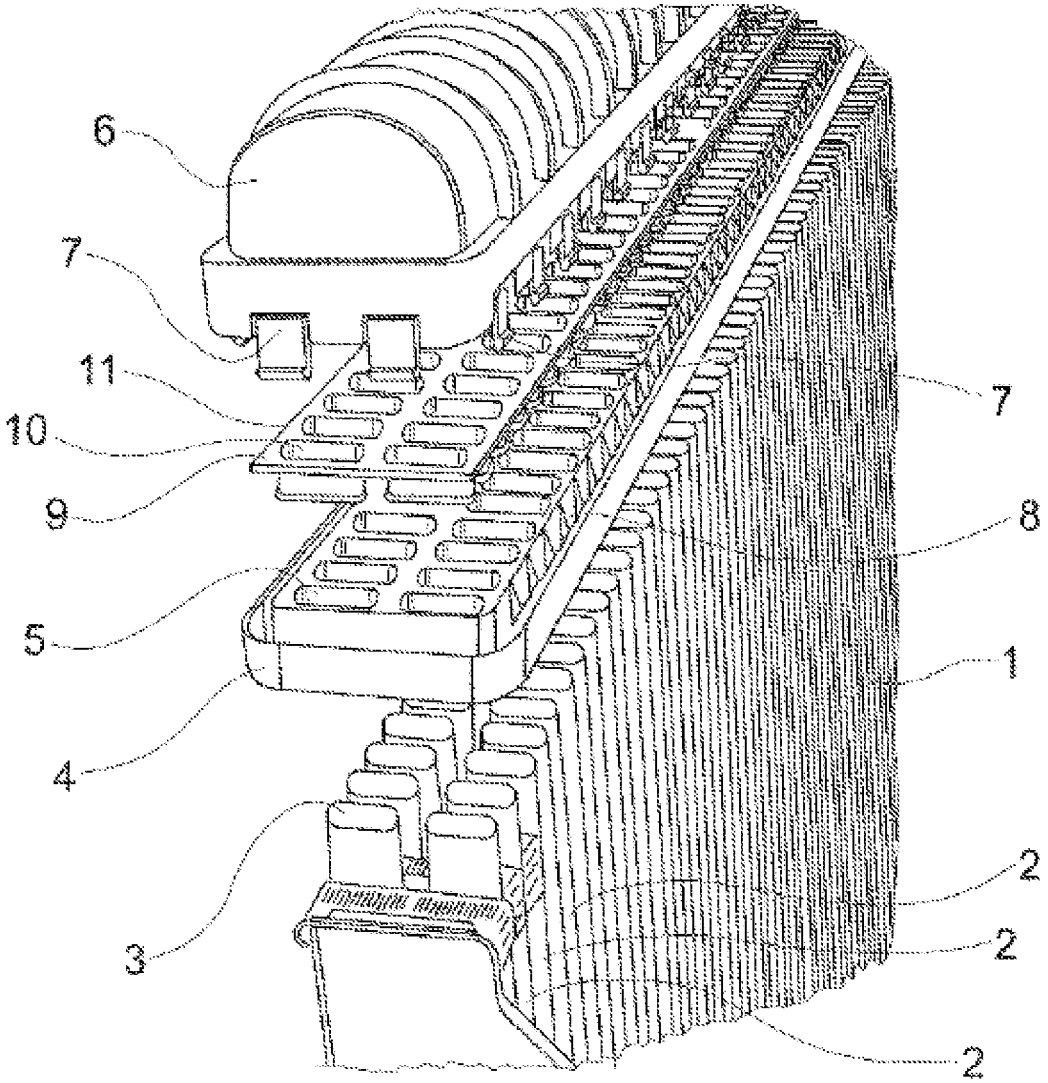
FIG. 1 illustrates a schematic exploded view of a first embodiment of a heat exchanger according to the present disclosure.

In each drawing, redundant features are designated by the same reference numerals.

FIG. 1 illustrates an exploded view of a first embodiment of a heat exchanger according to the present disclosure. Reference numeral 1 designates a block formed from a plurality of fluid guiding metal pipes 2 arranged side by side in the longitudinal direction. A multi-disk made of metal may be provided between the metal pipes. The pipe ends 3 of the metal pipes 2 have a narrow opening cross-section and are arranged side by side at intervals. Reference numeral 4 designates a pipe bottom made of plastic and having receiving through-holes 5 therein. The arrangement of the receiving through-holes 5 of the pipe bottom 4 coincides with the arrangement of the pipe ends 3 in the block 1, and consequently the pipe bottom 4 is seated on the pipe ends 3, in which case the pipe ends 3 may be inserted into the receiving through-holes 5 of the pipe bottom 4. A collection box 6 made of plastic may be connected to the pipe bottom 4 by clips 7 arranged in the collection box 6 and a locking device formed of locking openings 8 arranged to face the clips 7 in the pipe bottom 4. A seal 9 may be inserted between the pipe bottom 4 and the collection box 6, which ensures the press-fit of the pipe bottom 4 on the pipe ends 3 and seals the collection box 6 against the pipe bottom 4 and the pipe bottom 4 against the pipe ends 3. In the illustrated embodiment, since a compressible elastomeric seal with through-insertion openings 10 for the pipe ends 3 is used as the seal 9, the seal may be consequentially inserted between the inner surfaces of the receiving through-holes 5 and the outer circumferences of the pipe ends 3. In order to ensure press-fit of the pipe bottom 4 at the pipe ends 3, the cross-sections of the through-insertion openings 10 are implemented to be smaller than the cross-sections of the pipe ends 3. In addition, the seal 9 has an annular protrusion 11 which is formed in a lip shape at the outer circumferential edge of the seal 9 and surrounds the inside of the collection box 6 while sealing the collection box against the pipe bottom 4.

Figure 2:
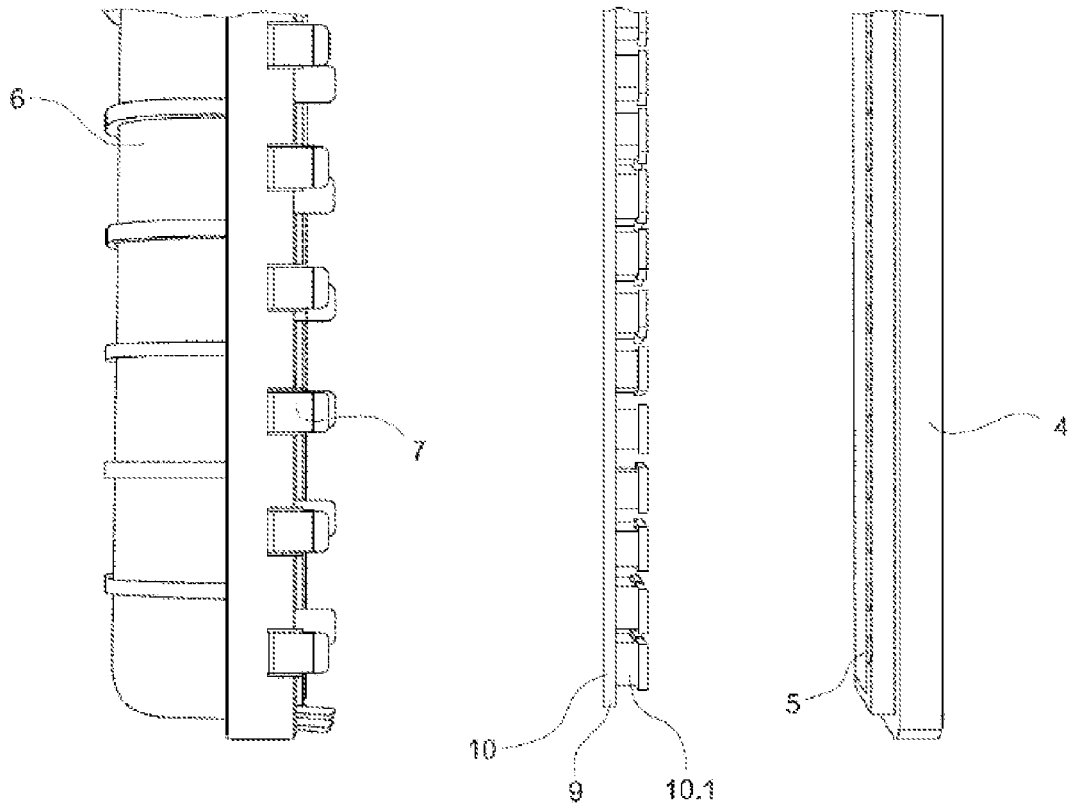
FIG. 2 illustrates a schematic view of a collection box with a seal and a pipe bottom when viewed from the side.

FIG. 2 illustrates a schematic view of the collection box 6 with the seal 9 and the pipe bottom 4 when viewed from the side. The seal 9 implemented as a compressible elastomeric seal has through-insertion openings 10 with through-insertion extensions 10.1, and the arrangement of the through-insertion openings coincides with the arrangement of the receiving through-holes 5 of the pipe bottom 4. The shapes and outer circumferences of the through-insertion extensions 10.1 coincide with the shapes and inner circumferences of the receiving through-holes 5. The cross-sections of the through-insertion openings 10 and the through-insertion extensions 10.1 are smaller than the cross-sections of the pipe ends 3, so that the seal 9 is pushed and elastically pressed against the pipe bottom 4 when the pipe ends 3 (not shown) are inserted into the through-insertion openings 10 or the through-insertion extensions 10.1, thereby providing a press-fit in the form of a forcibly coupled connection between the pipe bottom 4 and the pipe ends 3.

Figure 3:
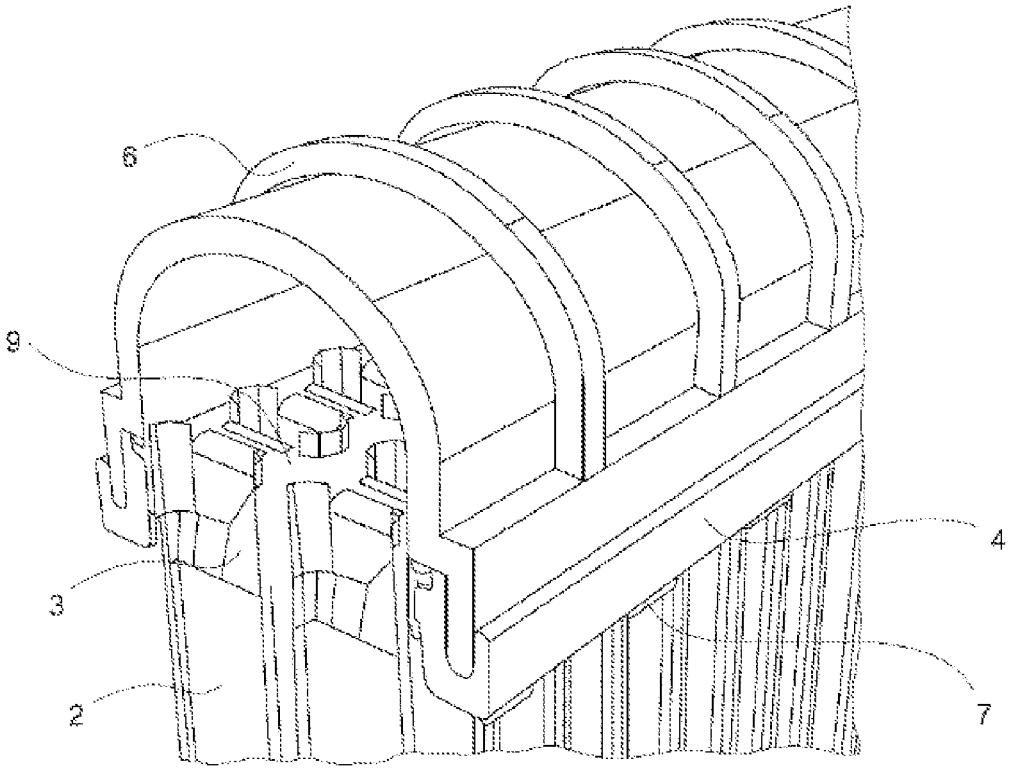
FIG. 3 illustrates a schematic cross-sectional view of the first embodiment, in which the collection box with the seal and the pipe bottom is engaged.

FIG. 3 illustrates a cross-sectional view of the first embodiment in the mounted state, in which case the collection box 6, the seal 9, the pipe bottom 4, and the pipe ends 3 are inserted into each other, in which case the compressible seal 9 causes the press-fit on the pipe ends 3, the sealing of the pipe ends 3 against the pipe bottom 4, and the sealing of the pipe bottom 4 against the collection box 6 to be ensured.

Figure 4:
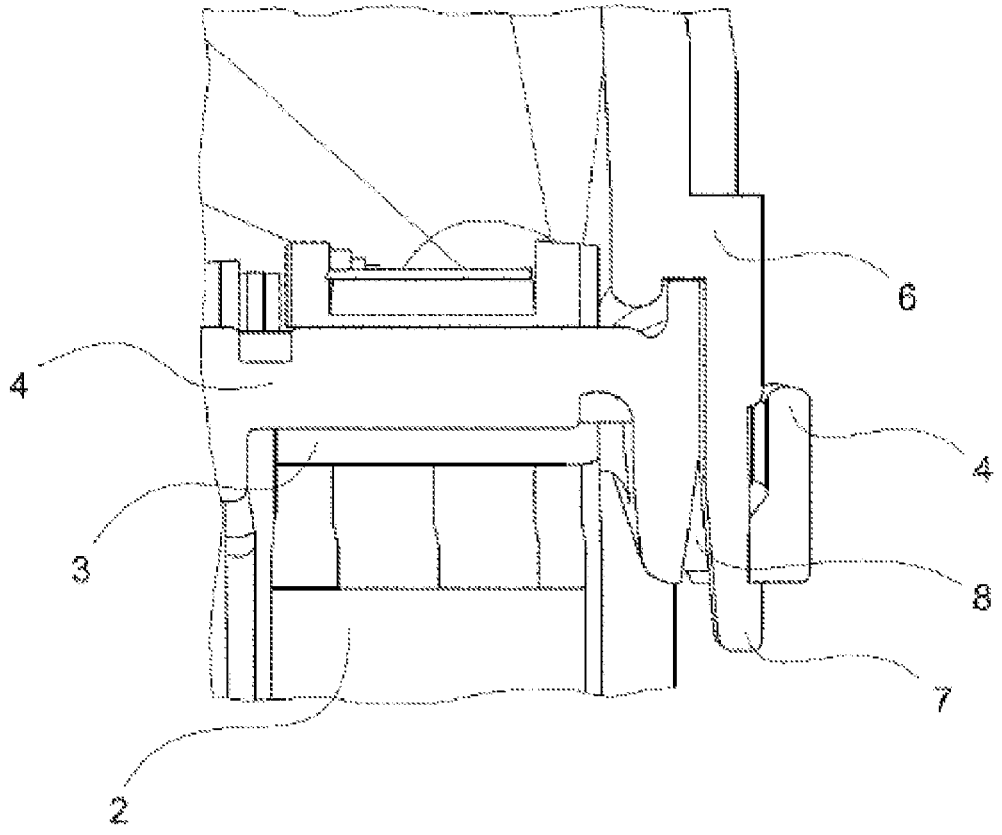
FIG. 4 illustrates a schematic detailed cross-sectional view of the first embodiment with no seal.

FIG. 4 illustrates a detailed cross-sectional view of the first embodiment with no seal between the pipe bottom 4 and the collection box 6. In the illustrated example, the pipe bottom 4 and the collection box 6 are arranged in the state in which they are inserted together, in which case the clips 7 of the collection box 6 are engaged into the locking openings 8 of the pipe bottom 4. If there is no seal between the pipe bottom 4 and the collection box 6, no fixed seating is ensured on the pipe ends 3 and the seal.

Figure 5:
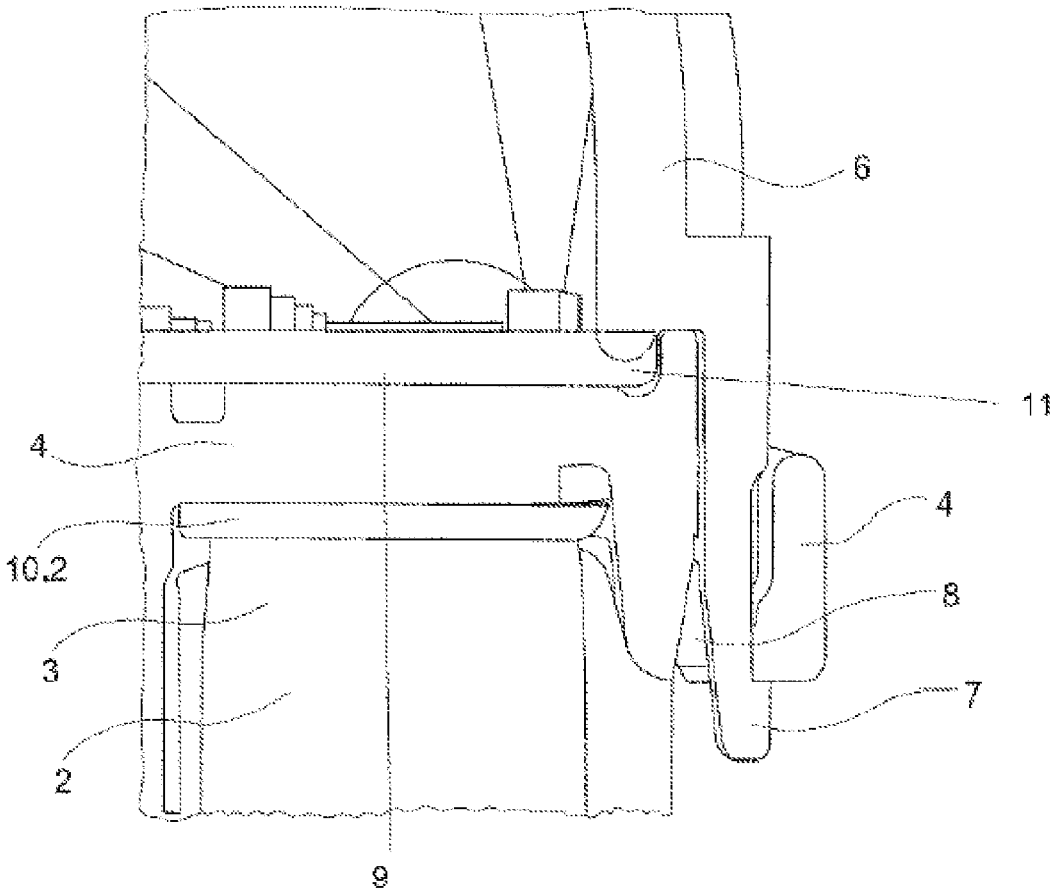
FIG. 5 illustrates a schematic detailed cross-sectional view of the first embodiment with the seal.

FIG. 5 illustrates a detailed cross-sectional view of the first embodiment, in which case the elastomeric seal 9 is inserted between the pipe bottom 4 and the collection box 6 and between the pipe bottom 4 and the pipe ends 3. Because the inner cross-sections of the through-insertion openings 10 with the through-insertion extensions 10.1 of the compressible elastomeric seal 9 are smaller than the outer cross-sections of the pipe ends 3, the elastomeric seal 9 is pressed toward the receiving through-holes 5, with the consequence that the press-fit of the pipe bottom 4 is ensured. In this case, the annular protrusion 11 formed in a lip shape at the outer circumferential edge of the elastomeric seal 9 is arranged between the pipe bottom 4 and the collection box 6. The annular protrusion 11 of the elastomeric seal 9 is compressed by the locking connection between the collection box 6 and the pipe bottom 4, so that the collection box 6 is sealed against the pipe bottom 4. Reference numeral 10.2 designates annular protrusions of the through-insertion extensions 10.1 of the through-insertion openings 10. The annular protrusions 10.2 ensure the fixed seating of the seal 9 in the receiving through-holes 5 of the pipe bottom 4, with the consequence that the seal is not pushed out when the tensile load or the shearing load is applied in the longitudinal direction of the metal pipe 2 such as may be caused during the thermal expansion of the metal pipe 2. Therefore, the above arrangement allows for the fixed seating and sealing of the pipe ends 3 in communication with the inside of the collection box 6.

Figure 6:
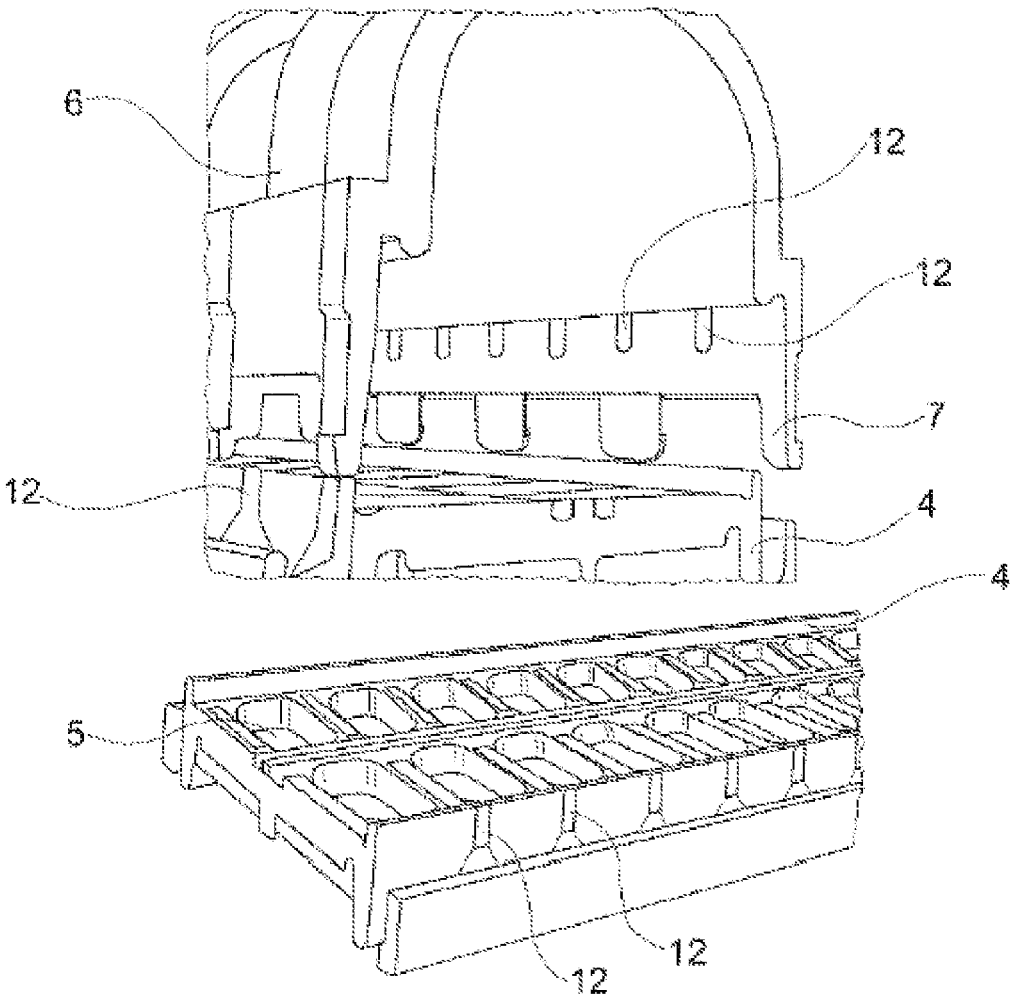
FIG. 6 illustrates a schematic view of a second embodiment of a heat exchanger according to the present disclosure.

FIG. 6 illustrates a schematic view of a second embodiment of a heat exchanger according to the present disclosure, which includes a pipe bottom 4 made of plastic and having receiving through-holes 5 in which pipe ends 3 (not shown) may be received, and a collection box 6 made of plastic and which may be connected to the pipe bottom 4 by a locking device formed between the pipe bottom and the collection box. In this case, a seal may be inserted between the pipe bottom 4 and the collection box 6, which ensures the press-fit of the pipe bottom 4 on the pipe ends 3 and seals the collection box 6 against the pipe bottom 4 and the pipe bottom 4 against the pipe ends 3. In a modified embodiment, the seal may be inserted between the pipe bottom 4 and the collection box 6 by welding in a material combination manner of the pipe bottom 4 and the collection box 6. The seal is formed by melting plastic which is a material of the collection box 6 and the pipe bottom 4. By means of the welding process, the plastic of the pipe bottom 4 may also be deformed to ensure the press-fit of the pipe bottom 4 on the pipe ends 3. Thus, the welding the plastic of the pipe bottom 4 and the collection box 6 allows for the connection in the material combination manner of components such as the pipe bottom 4 and the collection box 6 and the sealing against the pipe ends 3. Preferably, the pipe bottom 4 and the collection box 6 are welded to each other when seated on the pipe ends 3.

On the facing inner surfaces of the collection box 6 and the pipe bottom 4, junction points or welding points 12 arranged at intervals from each other are marked and the collection box 6 and the pipe bottom 4 may be welded to each other at these junction points or welding points. Preferably, the welding points 12 are distributed throughout the circumference of the arrangement consisting of the collection box 6 and the pipe bottom 4, resulting in uniform connection. By means of annular or point welding at the welding points, mechanical additional interconnection protruding over the locking connection of the locking device is made between the components such as the collection box 6 and the pipe bottom 4.

INDUSTRIAL APPLICABILITY

The present disclosure relates to a heat exchanger characterized by improved durability and reduced weight for variation in temperature. Such a heat exchanger is particularly suitable for application to vehicles.

The invention claimed is:

1. A heat exchanger comprising a plurality of fluid guiding metal pipes having pipe ends arranged side by side at intervals, at least one pipe bottom made of plastic and having receiving through-holes in which the pipe ends may be received, and a collection box made of plastic and which may be connected to the pipe bottom by a locking device formed between the pipe bottom and the collection box, wherein a seal is inserted between the pipe bottom and the collection box, and the seal ensures press-fit of the pipe bottom on the pipe ends and seals the collection box against the pipe bottom and the pipe bottom against the pipe ends, wherein the locking device comprises clips arranged in the pipe bottom or the collection box and locking openings arranged to face the clips in the pipe bottom or the collection box, wherein the seal is inserted between the pipe bottom and the collection box by welding in a material combination manner of the pipe bottom and the collection box, wherein welding points are arranged at intervals on facing inner surfaces of the collection box and the pipe bottom, and the collection box and the pipe bottom are welded to each other at the welding points, and wherein the welding points are distributed throughout the circumference of the arrangement consisting of the collection box and the pipe bottom.

2. The heat exchanger according to claim 1, wherein the seal is a compressible elastomeric seal having through-insertion openings with through-insertion extensions for the pipe ends, and the elastomeric seal is inserted between inner surfaces of the receiving through-holes and outer circumferences of the pipe ends.

3. The heat exchanger according to claim 1, wherein the seal is incorporated in the pipe bottom or the collection box by injection molding.

* * * * *